US005288973A

United States Patent [19]

Ota et al.

[11] Patent Number: 5,288,973

[45] Date of Patent: Feb. 22, 1994

[54] HEATER FOR SHEET MATERIAL

[75] Inventors: Shigeo Ota; Shingo Ooyama, both of Kyoto, Japan

[73] Assignee: Rohm Co., Ltd., Kyoto, Japan

[21] Appl. No.: 990,020

[22] Filed: Dec. 14, 1992

[30] Foreign Application Priority Data

Dec. 28, 1991 [JP] Japan ..... 3-359328
Dec. 30, 1991 [JP] Japan ..... 3-361518

[51] Int. Cl.[5] ..... H05B 1/00
[52] U.S. Cl. ..... 219/216; 219/543; 338/309; 355/390
[58] Field of Search ..... 219/543, 216; 338/195, 338/217, 307, 308, 309; 355/285, 289, 290

[56] References Cited

U.S. PATENT DOCUMENTS

| | | | |
|---|---|---|---|
| 3,126,470 | 3/1964 | Dillon | 219/543 |
| 3,995,142 | 11/1976 | Ciardelli et al. | 219/203 |
| 4,163,146 | 7/1979 | Meywald | 219/541 |
| 5,068,517 | 11/1991 | Tsuyuki et al. | 219/543 |
| 5,083,168 | 1/1992 | Kusaka et al. | 355/289 |
| 5,162,635 | 11/1992 | Sato et al. | 219/216 |

*Primary Examiner*—Bruce A. Reynolds
*Assistant Examiner*—Gregory L. Mills
*Attorney, Agent, or Firm*—William H. Eilberg

[57] ABSTRACT

A heater for heating a sheet material along a standard contact line comprises an insulating substrate, and a heating resistor strip formed on a surface of the substrate to extend longitudinally thereof. The resistor strip has an intermediate portion which is located transversely offset from the standard contact line, and a pair of end portions located at least partially at the standard contact line.

15 Claims, 7 Drawing Sheets

HEATER FOR SHEET MATERIAL

BACKGROUND OF THE INVENTION

1. Field of the Invention:

This invention relates generally to heaters. More specifically, the present invention relates to a linear heater which can be advantageously used in an office automation apparatus such as a photocopier or electrophotographic printer for fixing images on a paper sheet for example. The present invention also relates to a heating unit incorporating such a heater.

2. Description of the Prior Art:

Various types of linear heaters are known for fixing images (deposited toner) on a paper sheet in photocopiers or electrophotographic printers (e.g. laser beam printer). Typical examples include a lamp heater and a roller heater.

However, the lamp heater and roller heater are equally disadvantageous in that there is a limitation in reducing size (thickness) and cost. Further, the lamp heater is easily damaged due to the nature of material, whereas the roller heater has a complicated structure due to the necessity of incorporating plural heating elements within the roller.

To eliminate the problems of the conventional heaters, it has been proposed to use a strip heater for fixing images on a paper sheet in electrophotography. For the convenience of explanation, a typical arrangement of a prior art strip heater is shown in FIG. 11 of the accompanying drawings.

As shown in FIG. 11, the typical prior art strip heater comprises an elongate insulating substrate 100 having a surface formed with a printed resistor strip 101. Each end of the resistor strip 101 is connected to an enlarged terminal electrode 102 made of silver for connection to a power source (not shown). The resistor strip 101, which is made of e.g. silver-palladium alloy, generates heat when a current is passed therethrough.

Obviously, the prior art strip heater is very simple in arrangement. Further, the strip heater can be made very thin and light by reducing the thickness of the substrate 100. Moreover, the strip heater is also advantageous in that the time required for warming up is very short. However, the prior art strip heater still has the following problem.

Specifically, the enlarged terminal electrodes 102 made of silver are the portions where heat dissipation occurs most easily. Thus, when the resistor strip 101 is made to have a constant width over the entire length thereof, an uneven temperature distribution will result in which the surface temperature of the resistor strip is lower near the respective electrodes than at a central portion, as shown in FIG. 12. As a result, the heater will have an effective heating length A' which is non-negligibly smaller than the overall length A of the resistor strip 101. If the entire length A of the resistor strip 101 is utilized for heating, uneven image fixation will result. On the other hand, an attempt to increase the effective heating length A' will inevitably result in unacceptable elongation of the heater.

The above-described problem of the typical prior art strip heater can be solved by forming a resistor strip 101' which has a pair of end portions **101*a*' progressively reducing in width toward the respective electrodes 102, as shown in FIG. 13 and as taught in U.S. Pat. No. 5,068,517 to Tsuyuki et al (Patented: Nov. 26, 1991; Filed: Aug. 22, 1989). However, such a solution gives rise to a new problem that the narrower end portions 101*a*' of the resistor strip 101' are more easily broken because, in spite of the reduced width, the narrower end portions 101*a*'** generate a greater amount of heat than the central portion.

SUMMARY OF THE INVENTION

It is, therefore, an object of the present invention to provide a linear heater which is capable of uniformly heating a sheet material without increasing the likelihood of damaging a resistor strip.

Another object of the present invention is to provide a heating unit incorporating a linear heater which is capable of uniformly heating a sheet material without increasing the likelihood of damaging a resistor strip.

According to one aspect of the present invention, there is provided a heater for a sheet material comprising: an insulating substrate; and a heating resistor strip formed on a surface of the substrate to extend longitudinally thereof; wherein the resistor strip has an intermediate portion and a pair of end portions, the intermediate portion being transversely offset from the respective end portions.

According to another aspect of the present invention, there is provided a heating unit for a sheet material comprising: an insulating substrate; a heating resistor strip formed on a surface of the substrate to extend longitudinally thereof; and a platen for pressing the sheet material against the insulating substrate along a standard contact line; wherein the resistor strip has an intermediate portion which is located transversely offset from the standard contact line, the resistor strip further having a pair of end portions located at least partially at the standard contact line.

Other objects, features and advantages of the present invention will become apparent from the following detailed description of the preferred embodiments given with reference to the accompanying drawings.

DETAILED DESCRIPTION OF THE PREFERRED EMBODIMENTS

Figure 1:
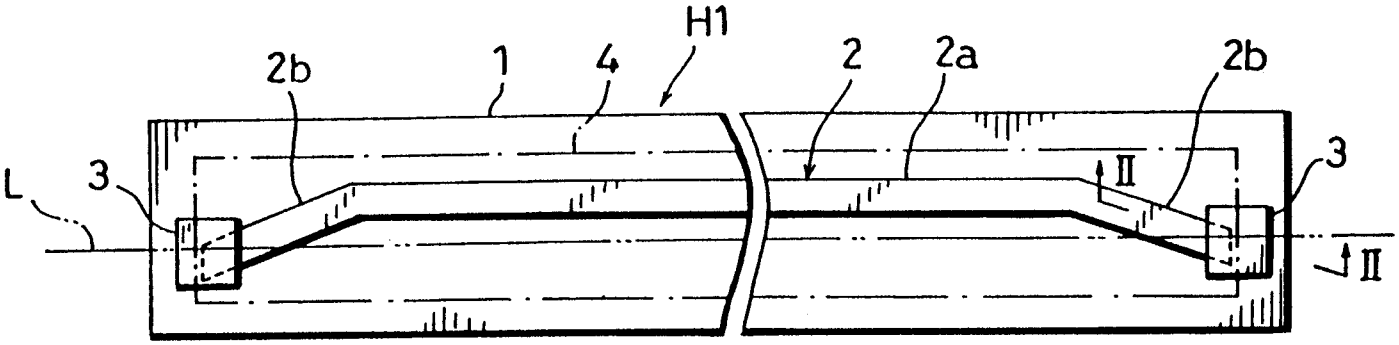
FIG. 1 is a plan view showing a heater according to a first embodiment of the present invention.

Preferred embodiments of the present invention are now described with reference to FIGS. 1 through 11 of the accompanying drawings. In these figures, like parts are designated by like reference numerals and characters.

EMBODIMENT 1

Figure 2:
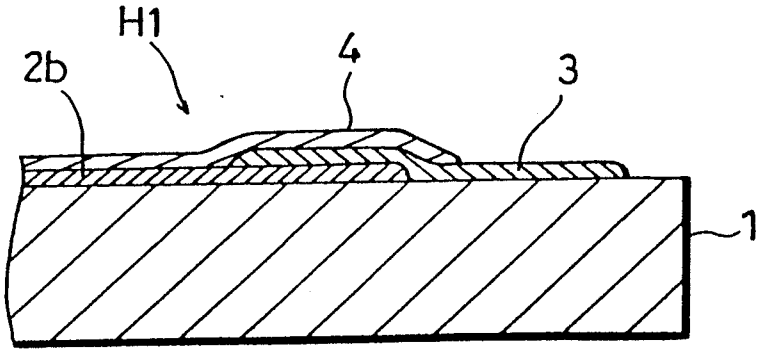
FIG. 2 is a fragmentary sectional view taken along lines II—II in FIG. 1.
Figure 3:
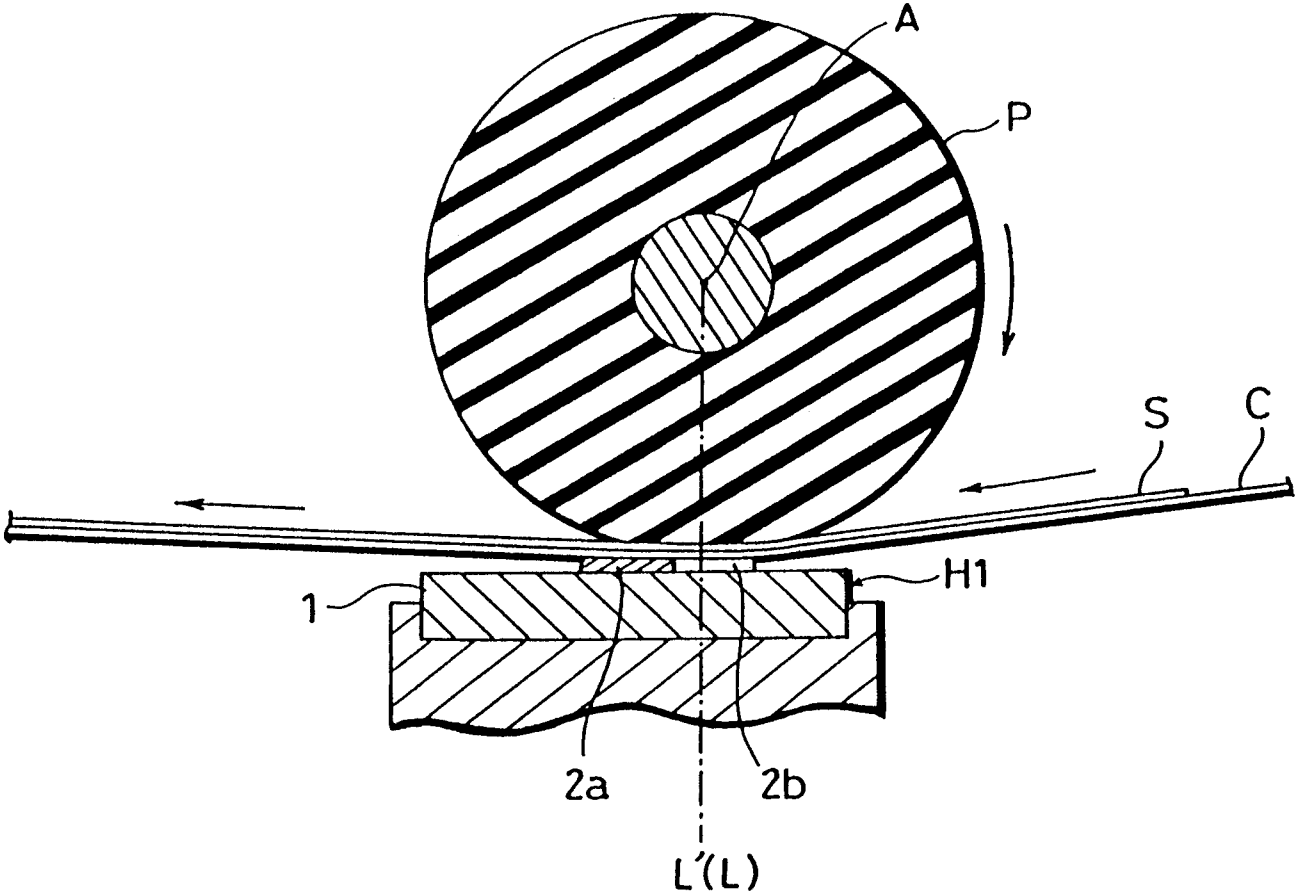
FIG. 3 is a view, in transverse section, showing the same heater as used in an electrophotographic printer for fixing images.

FIGS. 1-3 show a heater according to a first embodiment of the present invention.

Referring first to FIGS. 1 and 2, the heater H1 of this embodiment comprises an elongate substrate 1 made of a heat-resistant insulating material such as ceramic. The substrate has a top surface formed with a heating resistor strip 2 extending longitudinally of the substrate. Further, the top surface of the substrate carries a pair of enlarged terminal electrodes 3 electrically connected to the resistor strip 2. A protective glass coating 4 covers the entirety of the resistor strip 2 and part of the respective terminal electrodes 3 (see FIG. 2). The exposed portion of each electrode 3 is used for electrically connecting to a power supply line (not shown).

The resistor strip 2 may be made by printing silver-palladium paste in a strip form and then baking the paste for fixation. Similarly, the respective terminal electrodes 3 may be made by printing silver paste in a pad form and then baking the paste for fixation. Obviously, the resistor strip 2 may be made of any other suitable resistor material such as ruthenium oxide, whereas the terminal electrodes 3 may be made of any other suitable conductor material such as copper or gold.

According to the first embodiment, the resistor strip 2 is made to have an intermediate straight portion 2*a* and a pair of inclined end portions 2*b* (see FIG. 1). The heater H1 provides a standard contact line L extending longitudinally of the heater. As clearly appreciated in FIG. 1, the intermediate straight portion 2*a* of the resistor strip 2 is located transversely offset from the standard contact line L, whereas each of the inclined end portions 2*b* progressively approaches the contact line L for crossing therewith.

As shown in FIG. 3, the heater H1 having the above arrangement may be used in an electrophotographic printer for fixing images on a paper sheet S carrying deposited toner and supported on a carrier film C. In operation, the sheet S is pressed against the heater H1 along the standard contact line L (FIG. 1) by a cylindrical platen P. The longitudinal axis A of the platen P is contained in a plane L' which also contains the standard contact line L.

As already described in connection with the prior art, heat dissipation is higher at both ends of the heater H1 than at the central portion of the heater, so that the temperature of the resistor strip 2 is higher at the intermediate portion 2*a* than at the inclined end portions 2*b*. However, the paper sheet S is pressed against the heater H1 along the standard contact line L which passes or crosses the resistor end portions 2*b* but is slightly offset from the resistor intermediate portion 2*a*. Thus, the resistor end portions 2*b* thermally influences the paper sheet S to a greater degree than the resistor intermediate portion 2*a* to compensate for the uneven temperature distribution of the resistor strip 2.

Figure 13:
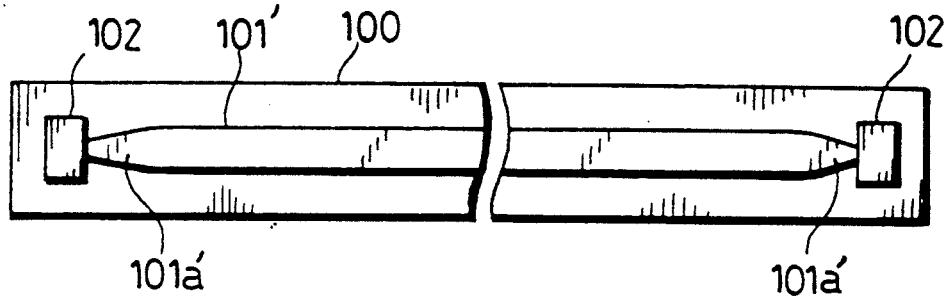
Fig. 13 Prior Art
FIG. 13 is a plan view showing another prior art heater.

As described above, the heater H1 provides uniform longitudinal heating, namely, uniform image fixation, for the paper sheet S. Nevertheless, the resistor strip 2 may have a constant width over the entire length thereof. Thus, it is possible to prevent a reduction of service life which would occur when the resistor strip is made to have constricted end portions (see FIG. 13).

EMBODIMENT 2

Figure 4:
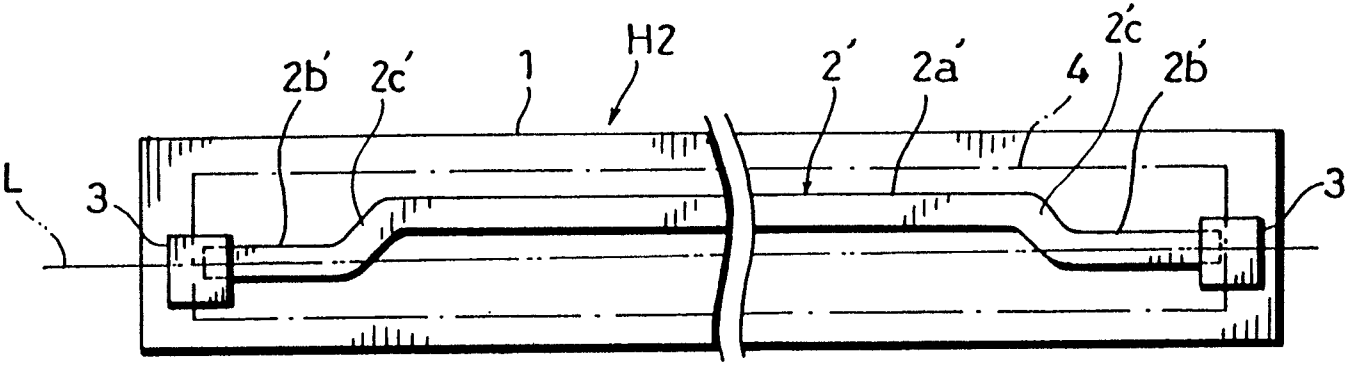
FIG. 4 is a plan view showing a heater according to a second embodiment of the present invention.

FIG. 4 shows a heater according to a second embodiment of the present invention.

Similarly to the foregoing embodiment, the heater H2 of the second embodiment comprises an elongate insulating substrate 1, a heating resistor strip 2', a pair of terminal electrodes 3, and a protective glass coating 4. The resistor strip 2' has an intermediate straight portion 2*a*' which is located transversely offset from a standard contact line L, and a pair of straight end portions 2*b*' located at the standard contact line L and connected to the intermediate portion 2*a*' respectively via inclined transition portions 2*c*'.

The resistor end portions 2*b*' which are located at the standard contact line L thermally influence a sheet material (not shown in FIG. 4) to a greater extent than the resistor intermediate portion 2*a*' which is located offset from the standard contact line L. Therefore, the heater H2 of the second embodiment provides the same advantages as that of the first embodiment.

EMBODIMENT 3

Figure 5:
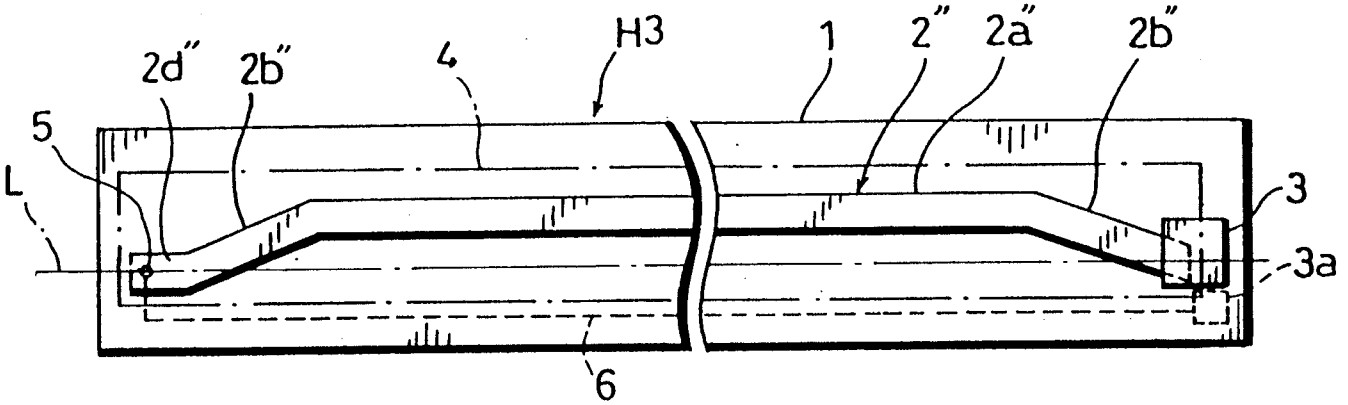
FIG. 5 is a plan view showing a heater according to a third embodiment of the present invention.

FIG. 5 shows a heater according to a third embodiment of the present invention.

Similarly to the first embodiment, the heater H3 of the third embodiment comprises an elongate insulating substrate 1 a heating resistor strip 2'', and a protective glass coating 4. The resistor strip 2'' has an intermediate straight portion 2*a*'' which is located transversely offset from a standard contact line L, and a pair of inclined end portions 2*b*'' approaching the standard contact line L for crossing therewith.

According to the third embodiment, one of the inclined end portions 2*b*'' of the resistor strip 2'' is directly connected to a terminal electrode 3 formed on the top surface of the substrate 1, whereas the other end portion 2*b*'' merges into an end extension 2*d*'' where a connection hole 5 is formed through the substrate 1. Further, the bottom surface of the substrate 1 is formed with a wiring conductor pattern 6 which is electrically connected to another terminal electrode 3*a* on the bottom surface of the substrate 1. The internal wall of the connection hole 5 is coated with a conductor material for establishing electrical connection between the resistor end extension 2*d*'' and the wiring conductor pattern 6.

Obviously, the heater H3 of the third embodiment enjoys the same advantages as that of the first embodiment because the resistor end portions 2*b*'' which are located at the standard contact line L thermally influence a sheet material (not shown in FIG. 5) to a greater extent than the resistor intermediate portion 2*a*'' which is located offset from the standard contact line L.

EMBODIMENT 4

Figure 6:
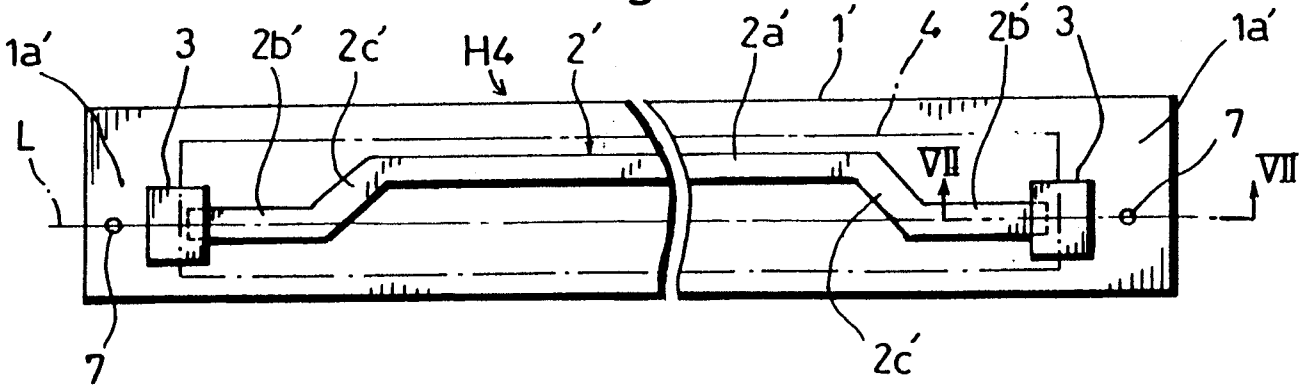
FIG. 6 is a plan view showing a heater according to a fourth embodiment of the present invention.
Figure 7:
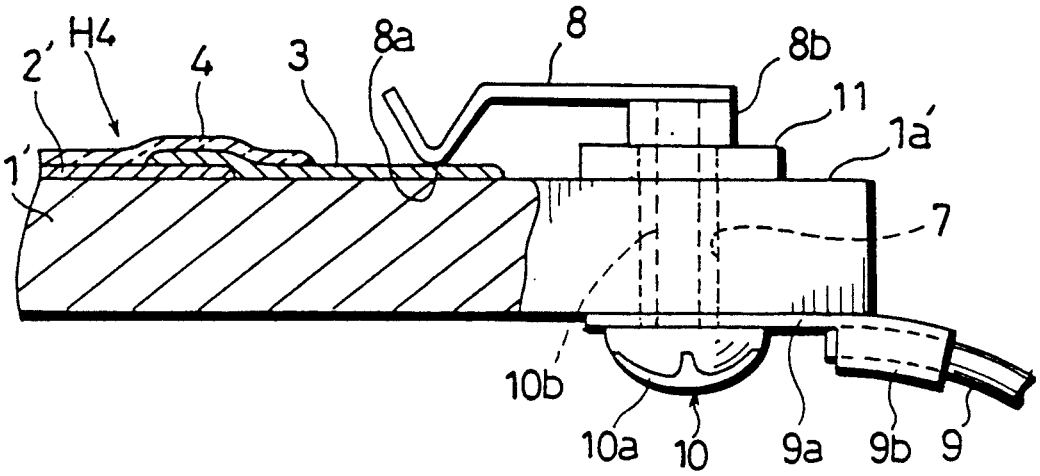
FIG. 7 is a fragmentary sectional view taken along lines VII—VII in FIG. 6.

FIGS. 6 and 7 show a heater according to a fourth embodiment of the present invention. The heater H4 of this embodiment is similar to that of the second embodiment (FIG. 4) but differs therefrom only in the following points.

First, an insulating substrate 1' is made to have a pair of excess end portions 1a' located outwardly from the respective terminal electrodes 3. Each of the excess end portions 1a' is formed with a mounting hole 7.

Secondly, each of the terminal electrodes 3 is held in contact with a pressing contact member 8, as shown in FIG. 7. The contact member 8, which is made of an elastic metal plate such as leaf spring, has a V-shaped contact portion 8a and a base stem 8b which is internally threaded. The contact member 8 is fixed on the corresponding excess end portion 1a' of the substrate 1' and electrically connected to a power supply line 9 by a bolt 10 having a head 10a and a threaded shank 10b.

The power supply line 9 is retained by a metallic connector plate 9a having a chuck portion 9b. When the bolt shank 10b is inserted through the mounting hole 7 into engagement with the base stem 8b of the contact member 8, the connector plate 9a is sandwiched between the bolt head 10a and the substrate end portion 1a'. Indicated at 11 is a spacer interposed between the base stem 8b and the substrate end portion 1a'.

Besides the advantages which are obtainable by transversely offsetting the intermediate straight portion 2a' of the resistor strip 2' from the standard contact line L, the heater H4 of the fourth embodiment enjoys the following additional advantages.

Due to the use of the contact member 8, electrical connection between each terminal electrode 3 and the corresponding power supply line 9 is established simply by bolting.

Further, since the contact member 8 is mounted on the corresponding excess end portion 1a' of the substrate 1', the contact member 8 is movable with the excess end portion 1a' even if the substrate 1' expands linearly during the heating operation. Thus, no slide occurs between the contact member 8 and the terminal electrode 3 at the time of heating, so that it is possible to prevent an increase of electrical resistance (namely, a temperature rise) which would be caused by a slide at the contact connection. As a result, the electrical connection between the contact member 8 and the terminal electrode 3 is rendered more reliable and endurable than if the contact member is fixed to a separate machine frame to result in relative slide between the contact member and the terminal electrode.

On the other hand, if the terminal electrode 3 is directly connected to the power supply line 9 by soldering, it is necessary to use high melting point solder because the resistor strip 2' is heated to a high temperature of about 200° C. The use of such solder makes the soldering operation more time taking but yet provides inferior electrical connection than using low melting point solder.

Alternatively, it is also conceivable to use conductive adhesive for electrically connecting the terminal electrode 3 to the power supply line 9. However, being lower in conductivity than solder, the conductive adhesive must be applied in such a large amount as to entirely cover the terminal electrode 3 for ensuring an enough current corresponding to the required heat generation. As a result, thermal stresses are repetitively applied to the conductive adhesive due to a difference in thermal expansion between the conductive adhesive and the substrate 1' (having a lower coefficient of thermal expansion), consequently causing a damage to the electrical connection.

Apparently, the use of the contact member 8 completely eliminates the problems encountered in using high melting point solder or conductive adhesive for establishing the required electrical connection.

EMBODIMENT 5

Figure 8:
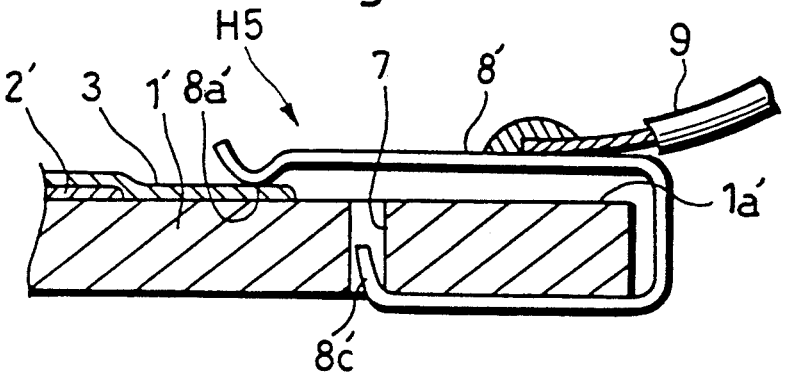
FIG. 8 is a fragmentary sectional view similar to FIG. 7 but showing a heater according a fifth embodiment of the present invention.

FIG. 8 shows a heater H5 according to a fifth embodiment of the present invention. The heater of this embodiment is similar to that of the fourth embodiment (FIGS. 6 and 7) but differs therefrom only in that use is made of a clip-type contact member 8'.

The clip-type contact member 8', which is made by bending a leaf spring generally into a U-shape, has a bent or curved contact portion 8a' for pressing contact with a corresponding terminal electrode 3. The contact member 8' further has a bent anchoring portion 8c' engaging in a corresponding mounting hole 7 which is formed in a corresponding excess end portion 1a' of the substrate 1'. A power supply line 9 may be connected to the contact member 8' by using low melting point solder.

For assembly, the contact member 8' need only be elastically opened for fitting over the corresponding excess end portion 1a' of the substrate 1'. Thus, the heater H5 of the fifth embodiment is preferred for its particular simplicity of assembly.

EMBODIMENT 6

Figure 9:
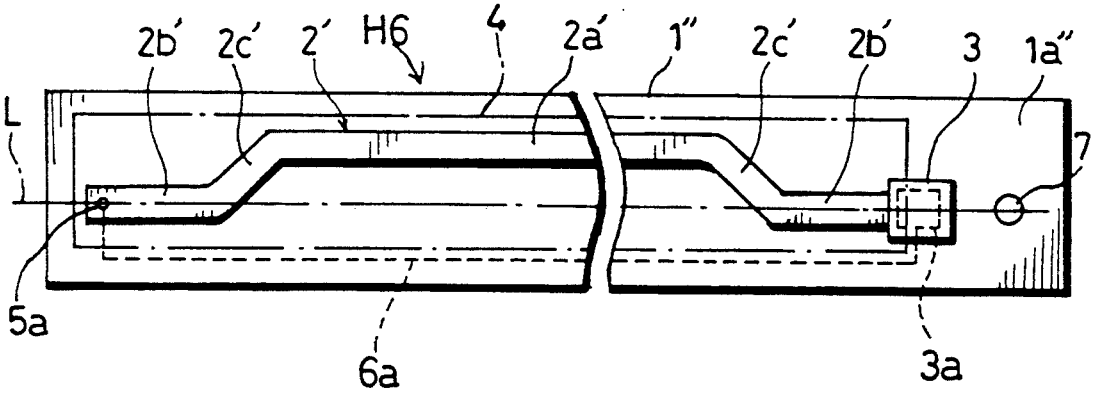
FIG. 9 is a plan view showing a heater according to a sixth embodiment of the present invention.
Figure 10:
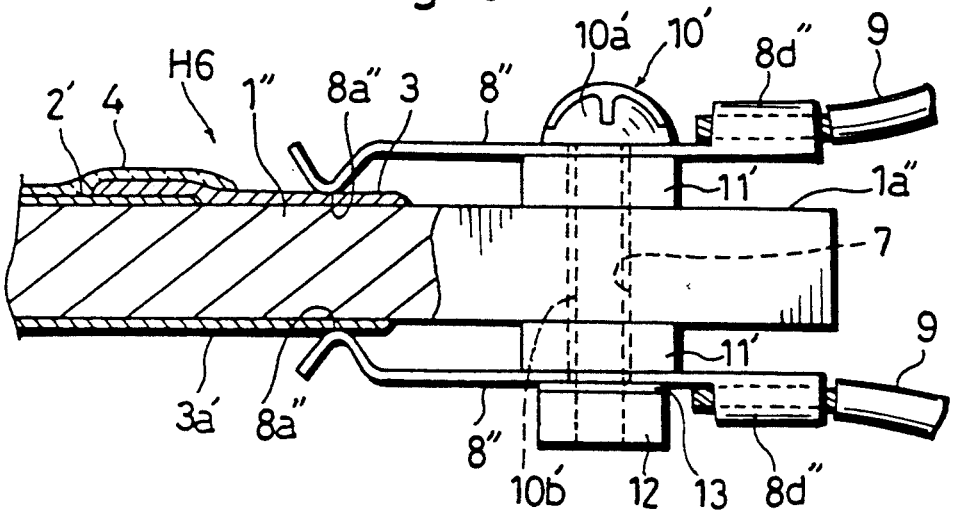
FIG. 10 is a fragmentary view showing a principal portion of the heater shown in FIG. 9.
Figure 11:
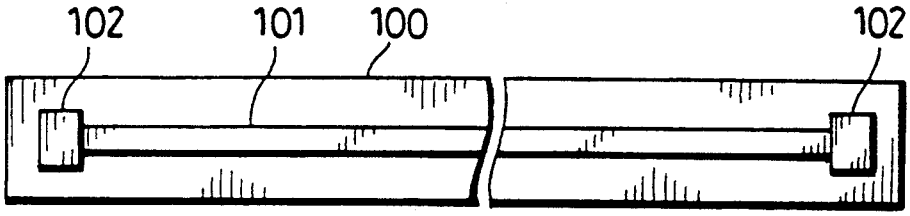
Fig. 11 Prior Art
FIG. 11 is a plan view showing a prior art heater.
Figure 12:
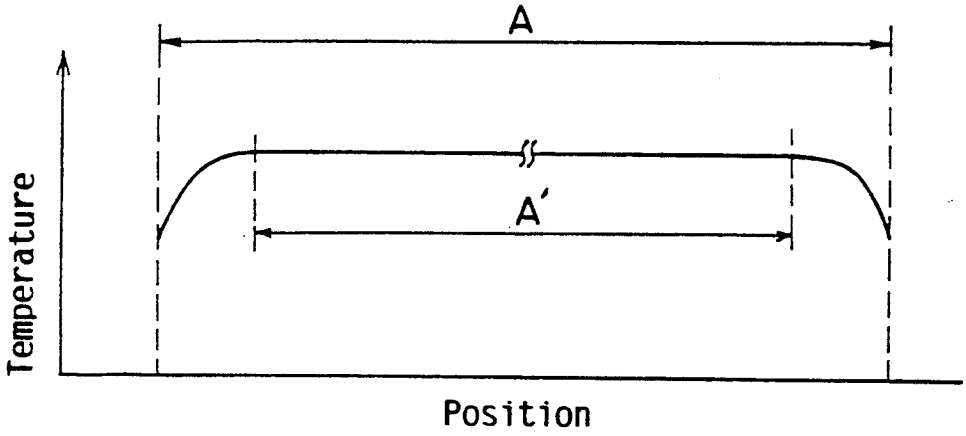
Fig. 12 Prior Art
FIG. 12 is a graph showing the longitudinal temperature distribution obtainable by the prior art heater of FIG. 11.

FIGS. 9 and 10 show a heater according to a sixth embodiment of the present invention. The heater H6 of this embodiment is similar to that of the fourth embodiment (FIGS. 6 and 7) but differs therefrom only in the following points.

Specifically, an insulating substrate 1'' is made to have only one excess end portion 1a'' which is formed with a mounting hole 7. One of the end portions 2b' of the resistor strip 2 located near the excess end portion 1a'' of the substrate 1'' is directly connected to a terminal electrode 3 formed on the top surface of the substrate 1''.

On the other hand, the other end portion 2b' of the resistor strip 2' is electrically connected through a connection hole 5a to a wiring conductor pattern 6a which is formed on the bottom surface of the substrate 1''. The internal wall of the connection hole 5a is coated with a conductor material, and the wiring conductor pattern 6a extends to another terminal electrode 3a' on the bottom surface of the substrate 1'' in overlapping relation to the first-mentioned electrode 3.

The two terminal electrodes 3, 3a are held in pressing contact with respective contact members 8''. Each of the contact members 8'', which is made of an elastic plate such as leaf spring, has a V-shaped contact portion 8a'' and a chuck portion 8d'' for connection to a power supply line 9.

The respective contact members 8'' are spaced from the substrate 1'' by means of respective spacers 11' but fixed to the substrate 1'' commonly by means of a single bolt 10'. This bolt has a head 10a' engaging one of the contact members 8'', and a threaded shank 10b' engaging in a nut 12 which abuts the other contact member via an insulating washer 13.

Obviously, the insulating washer 13 ensures electrical separation between the two contact members 8''. However, if the bolt 10' is made of a non-conductive material, the washer 13 may be dispensed with.

Apparently, the heater H6 of the sixth embodiment is advantageous in the additional simplicity of assembly because the single bolt 10' is used commonly to fix the two contact members 8''.

The present invention being thus described, it is obvious that the same may be varied in many ways. For instance, any heater according to the present invention may be also used for heat-sealing a thermoplastic sheet in addition to image fixation. Such variations are not to be regarded as a departure from the spirit and scope of the the invention, and all such modifications as would be obvious to those skilled in the art are intended to be included within the scope of the following claims.

We claim:

1. A heating unit for a sheet material comprising:

an electrically insulating substrate;

a heating resistor strip formed on a surface of the substrate to extend longitudinally thereof; and a platen for pressing the sheet material into contact with the insulating substrate along a contact line;

wherein the resistor strip has an intermediate portion which is located transversely offset from the contact line, the resistor strip further having a pair of non-branching end portions located at least partially at the contact line.

2. The heating unit according to claim 1, wherein the intermediate portion of the resistor strip is substantially straight.

3. The heater according to claim 1 wherein the respective end portions of the resistor strip are inclined and extend from the intermediate portion to progressively approach the contact line.

4. The heating unit according to claim 1, wherein the respective end portions of the resistor strip extend substantially straight at and along the contact line.

5. The heating unit according to claim 4, wherein each of the straight end portions of the resistor strip is connected to the intermediate portion via an inclined transition portion.

6. The heating unit according to claim 1, wherein the resistor strip is entirely covered by a protective coating.

7. The heating unit according to claim 1, wherein each of the end portions of the resistor strip is electrically connected to a terminal electrode formed on the surface of the substrate, the electrode being electrically connected to a power supply line.

8. The heating unit according to claim 7, wherein the terminal electrode is electrically connected to the power supply line via a pressing contact member which is fixed to the substrate adjacent to the terminal electrode.

9. The heating unit according to claim 8, wherein each end of the substrate has an excess portion, the contact member being fixed to the excess end portion of the substrate.

10. The heating unit according to claim 8, wherein the contact member is fixed to the substrate by bolting.

11. The heating unit according to claim 8, wherein the contact member is in the form of a clip which is elastically openable for fitting over said each end of the substrate.

12. The heating unit according to claim 1, wherein one end portion of the resistor strip is electrically connected to a terminal electrode formed on the surface of the substrate, whereas the other end portion of the resistor strip is electrically connected to another terminal electrode formed on another surface of the substrate opposite to the first-mentioned surface, the respective electrodes being electrically connected to corresponding power supply lines.

13. The heating unit according to claim 12, wherein the terminal electrodes are electrically connected to the corresponding power supply lines respectively via pressing contact members which are fixed respectively to the opposite surfaces of the substrate adjacent to the electrodes.

14. The heating unit according to claim 13, wherein one end of the substrate has an excess portion, the respective contact members being fixed to the excess end portion of the substrate.

15. The heating unit according to claim 14, wherein the respective contact members are fixed to the substrate commonly by a single bolt.

* * * * *